United States Patent [19]

Alford

[11] 4,207,576

[45] Jun. 10, 1980

[54] MEANS FOR REDUCING RE-RADIATION FROM TALL GUYED TOWERS LOCATED IN A STRONG FIELD OF A DIRECTIONAL AM RADIO STATION

[76] Inventor: Andrew Alford, 71 Bacon St., Winchester, Mass. 01890

[21] Appl. No.: 957,521

[22] Filed: Nov. 3, 1978

Related U.S. Application Data

[63] Continuation-in-part of Ser. No. 813,763, Jul. 7, 1977, which is a continuation-in-part of Ser. No. 808,290, Jun. 20, 1977, abandoned.

[51] Int. Cl.[2] ..... H01Q 1/52

[52] U.S. Cl. ..... 343/885

[58] Field of Search ..... 343/885, 874, 890, 904, 343/905; 174/208

[56] References Cited

FOREIGN PATENT DOCUMENTS 1264541 9/1959 Fed. Rep. of Germany ..... 343/885

*Primary Examiner*—Eli Lieberman

[57] ABSTRACT

A method for decreasing radiation from a guy wire located in a strong electromagnetic field is disclosed. The method comprises placing inductive impedances at regular intervals along a guy wire, each interval being less than a half wavelength long. Each inductive impedance is made greater than $Z_o$ but usually less than 5 $Z_o$ where $Z_o$ is the characteristic impedance of the span between inductances. It is shown that induced current distribution in a span between inductances has, say, a negative current in the central portion of the span and positive currents near the two ends of the span. It is this reversal of the direction of the induced current, together with low magnitude, that results in very low re-radiation. In practice the inductive impedances may be constructed by using coils in shunt with guy insulators. In some applications the inductive impedances may take a different form, for example, inductive sleeves or just coils may be used as inductances.

9 Claims, 13 Drawing Figures

FIG. 1 A GUY WIRE BROKEN BY INSULATORS. DEFINITIONS OF $Z_1$, $Z_2$, AND OF $\theta$

MEANS FOR REDUCING RE-RADIATION FROM TALL GUYED TOWERS LOCATED IN A STRONG FIELD OF A DIRECTIONAL AM RADIO STATION

This patent application is a continuation in part of my patent application Ser. No. 813,763, filed July 7, 1977, which in turn is a continuation in part of my patent application, Ser. No. 808,290, filed June 20, 1977, now abandoned.

This invention relates to means for reducing re-radiation from currents induced in guy wires of tall towers, for example 1000 feet high. Such towers usually have 3 sets of guy wires placed approximately 120° apart in azimuth. Each set may consist of 5 or 6 guys. One or two anchors may be used for all of the guy wires in one set. The diameter of guy wires may vary from 2" down to about 1⅜", most of them being around 1⅝" in diameter. If such a tower is placed in the strong field of a directional AM radio station, which must protect one or several sectors of the azimuth, re-radiation from the guy wires can contribute a substantial portion of the re-radiated signal from the overall tower structure. It has been customary, under such circumstances, to break up the guy wires by insulators made for this purpose. Such an insulator consists of one or two metal yokes with dielectric material used in compression placed between the metal parts connected to the two adjacent guy wire spans. The capacitance of such an insulator assembly made for use in a guy wire 1½ inches in diameter is around 60 pF. For guys having diameters around 2 inches 70 pF capacitance may be expected. A guy wire broken up by insulators placed at equal intervals that are less than ½ wavelength long are usually expected to re-radiate substantially less signal than a guy wire of the same length and orientation without insulators.

The re-radiation pattern of a guy wire set consisting, for example, of six guys in the same vertical plane is directional with one or two major lobes. The re-radiated field, when measured at one mile from a guy wire in the direction of maximum re-radiation, is primarily a function of the span length expressed in wavelengths at the frequency of the inducing signal and of the insulator capacitance. A set of six guys, in the same vertical plane, for an 1100 foot tower with quarter wave spans between 70 pF insulators typically results in roughly 57 mv/m for every volt/meter of the inducing signal at the guy wire set. If the span length in such a guy wire set is decreased from ¼ of the wavelength to 1/6th of the wavelength, the re-radiated field drops to roughly 12.6 mv/v at 1 mile for each volt/meter of the inducing field. The number of insulators required for each guy set depends on the frequency of the inducing signal. When this frequency is near the top of the AM radio band, for example, 1540 KHz, the number of insulators is large, namely, around 40 per guy set with ¼ wavelength spans and 60 per guy set with 1/6 wave length spans. Three such guy wire sets are required for a tall tower. Insulator assemblies capable of withstanding guy wire tensions are very expensive. It is not unlikely that insulator assemblies alone for three guy sets would cost $150.00 or more if short spans are used.

Even with short spans the residual re-radiated signal may be greater than can be tolerated. It is important, therefore to find a means for decreasing the current induced in each span. One way of accomplishing this result is by effectively decreasing the insulator capacitances by shunting each insulator with a resonant coil.

When this is done the re-radiated signal from a guy wire set with ¼ wavelength spans drops from 57 mv/m at 1 mile to about 27 mv/m for each volt/meter of the inducing field.

While investigating the possible use of shunt coils it occured to me that in practice there was some chance that the coil inductances may be made a little too small for full resonance so that inductive loading would result converting the guy wire into a kind of a low pass filter. A detailed calculation revealed that the pass band extends from zero up to a certain span length which I called the cut-off span length. For spans longer than this cut-off length, but shorter than ½ wavelength, a guy wire with inductive loading behaves like a filter in the cut-off region. The cut-off span length depends on the value of inductive impedance. Investigating further, I found that current induced in a ¼ wave span with inductive loading is substantially lower than the current induced in spans with coil resonated insulators and that furthermore the induced current in the central portion of a span is flowing, say, to the right while the currents near the two ends are flowing to the left. This phenomenon lead me to expect that radiation from a span carrying such currents would be very low. This is indeed the case. I find, for example, that a guy wire set of 40¼ wavelength spans loaded by inductive impedances equal to above 2½ times, the characteristic impedance of the span (roughly 420 ohms) result in only 7 mv/m at 1 mile for each volt/meter of the inducing field. This is roughly 1/9th of the field (57 mv/m) re-radiated by a guy set with ¼ spans separated by 70 pF capacitors at 1 mile per v/m.

For each span length there is a value of inductive impedance which results in the least radiation, for example, with inductive reactants 3.93 times the characteristic impedance for 90° spans, the re-radiated signal at right angles to a span vanishes and only very small minor lobes are radiated. This condition corresponds to the cut-off span length of 54° which is much shorter than the actual span length of 90°. Inductive loading with impedances 2.5 times the characteristic impedance still gives an improvement factor of about 9.3 over the 72 pF insulators alone at 1.54 MHz. The cut-off span length under these conditions is about 77.3° which is pretty well below the operating condition. It is obviously a matter of choice just how close one wishes to operate to the cut-off span length. For 120° spans the least re-radiated signal condition results in the cut-off span length of 69° which is well below the 120° span length. A very large reduction of re-radiation is obtained with 120° spans separated by inductive impedances about 2.8 times the characteristic impedance.

One way to achieve inductive loading in practice is by using coils in shunt connection with the guy insulators. The inductive impedance is obtained when the coil has an inductance that is lower than that which results in resonance with the capacity of the insulator. The required coils may be designed by methods well known in the art. The following is an example of a coil, which, when connected in shunt with a 72 pF insulator, results in impedance about 2.5 times the characteristic impedance $Z_o=424$ ohms at 1.54 MHz. The coil is 6 inches in diameter, 12 inches long, is wound with about 29 turns of copper wire about 0.128 inches in diameter. Such a coil could be incapsulated in a fiber glass cylinder field with dielectric foam to keep out moisture.

One object of my invention is to provide a means for reducing re-radiation from guy wires of a tall tower located in the field of a directional AM radio station.

Another object of my invention is to reduce the required number of insulators and still obtain low re-radiation from the guy wires.

Still another object is to provide a simple and effective means for reducing re-radiation from guy wires of medium or short towers when very low re-radiation levels are required.

Other objects, features and advantages of the present invention will be apparent from the following description of embodiments of the invention which represent the best known use of the invention. These embodiments are shown in the accompanying drawings.

FIGURES

Figure 3:
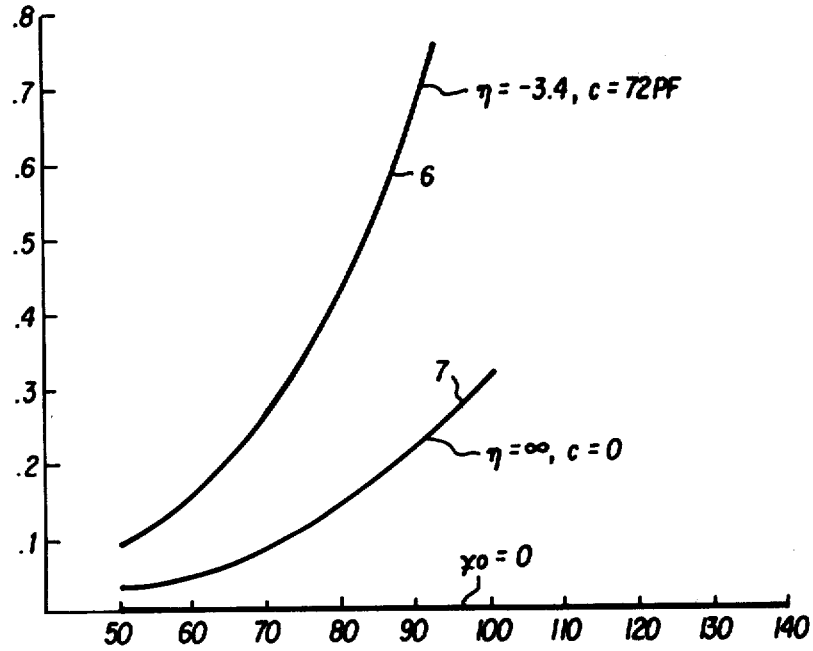

FIG. 3 curve 6, shows values of $v_o$ plotted as a function of span length $\theta=360°$ S/λ for $\eta=-3.4$ corresponding to 72 pF capacitors. Curve 7 corresponds to capacitors resonated by coils ($\zeta \flat \infty$).

Figure 4:
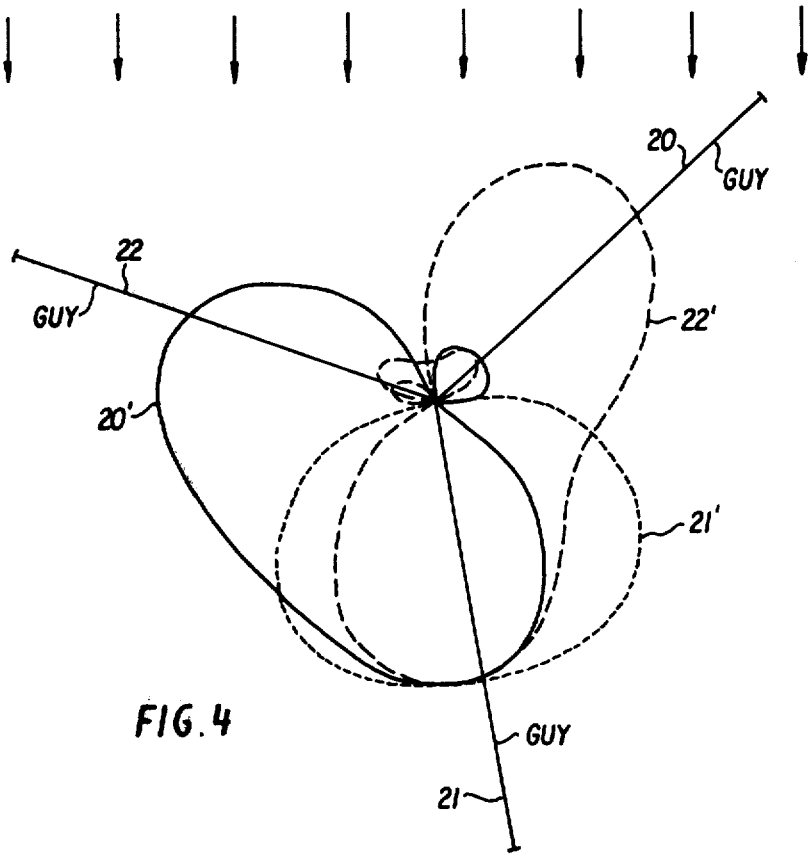

FIG. 4 shows the shapes of the directional patterns re-radiated by an arrangement of three sets of guy wires.

Figure 5:
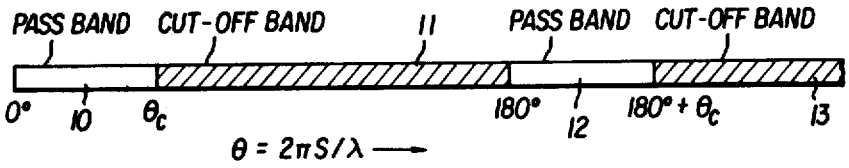

FIG. 5 shows pass bands and cut-off bands of a guy wire loaded with inductances with $\eta=2.5$ plotted vs. span length in electrical degrees.

Figure 6:
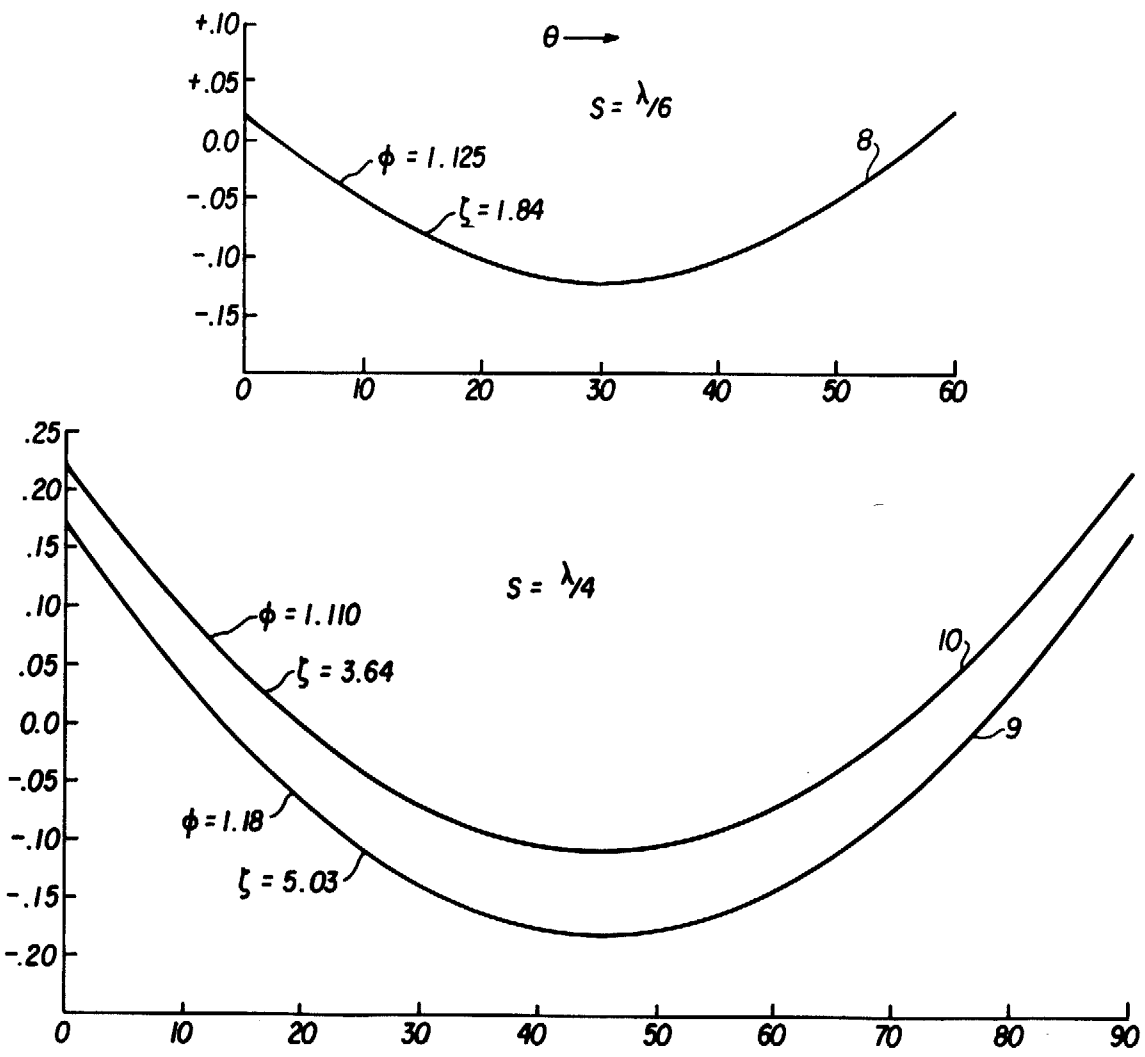

FIG. 6 shows the distributions of induced currents. Curve 8 is for a 60° span for $\Phi=1.125$, $\zeta=1.84$. Curve 9 is for a 90° span with $\Phi=1.18$, $\zeta=5.03$ and Curve 10 is for a 90° span with $\Phi=1.110$ $\zeta=3.64$.

Figure 7:
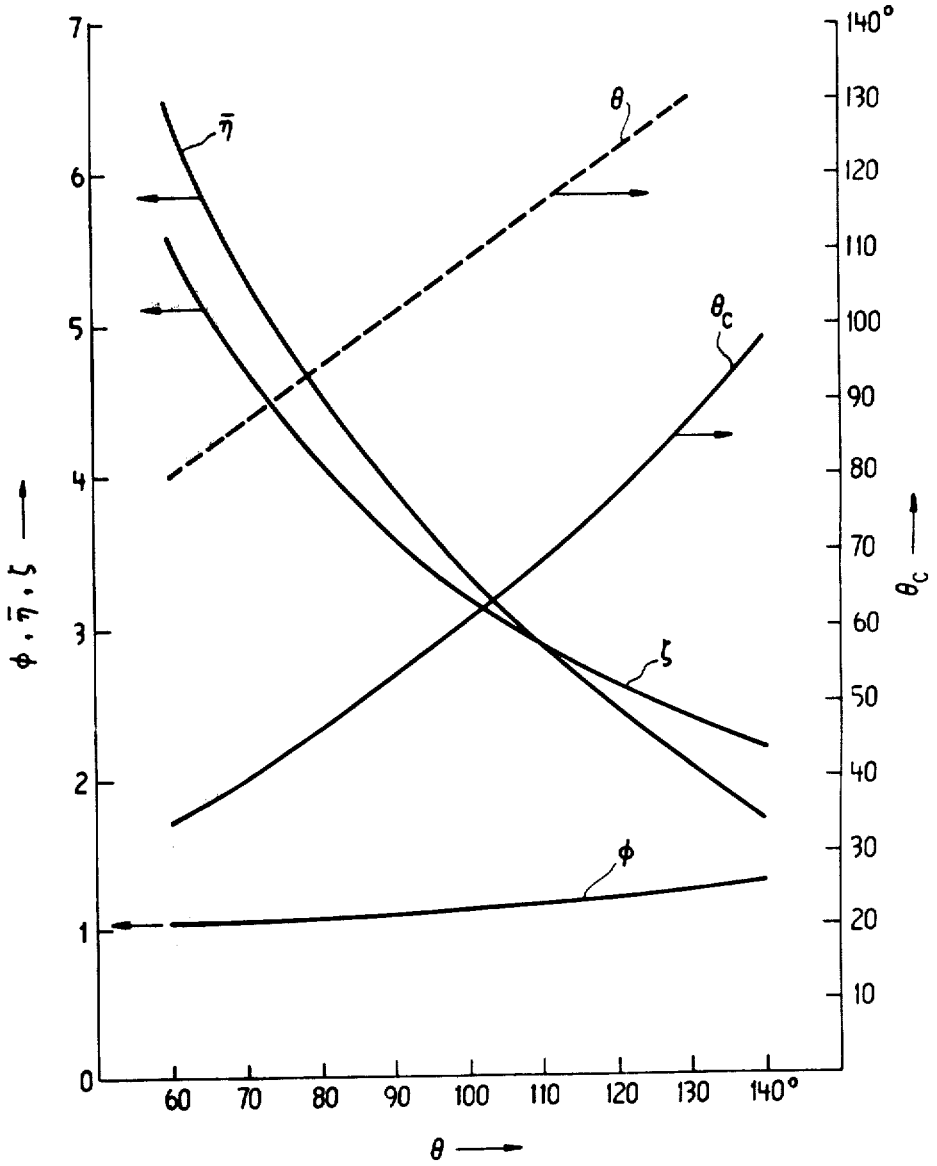

FIG. 7 shows the value of $\eta$, and $\zeta$ which result in minimum radiation at right angles to spans of various lengths when the wave front falls parallel to the spans.

Figure 8:
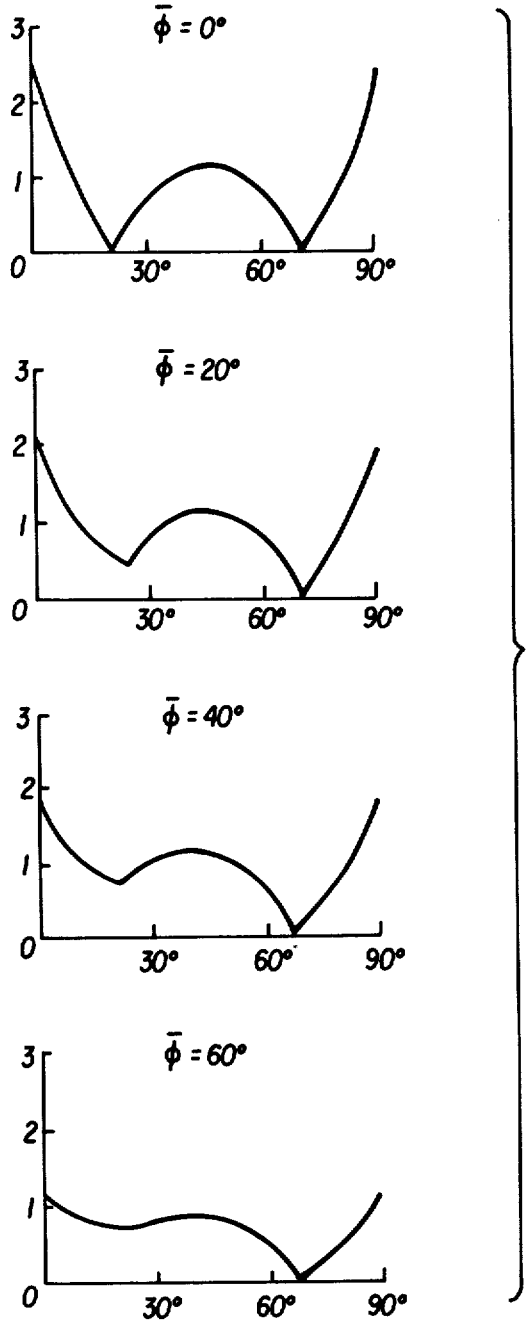

FIG. 8 Magnitude of the induced current along a 90° span plotted for several values of the angle $\theta$ between the incoming wave front and the span.

Figure 9:
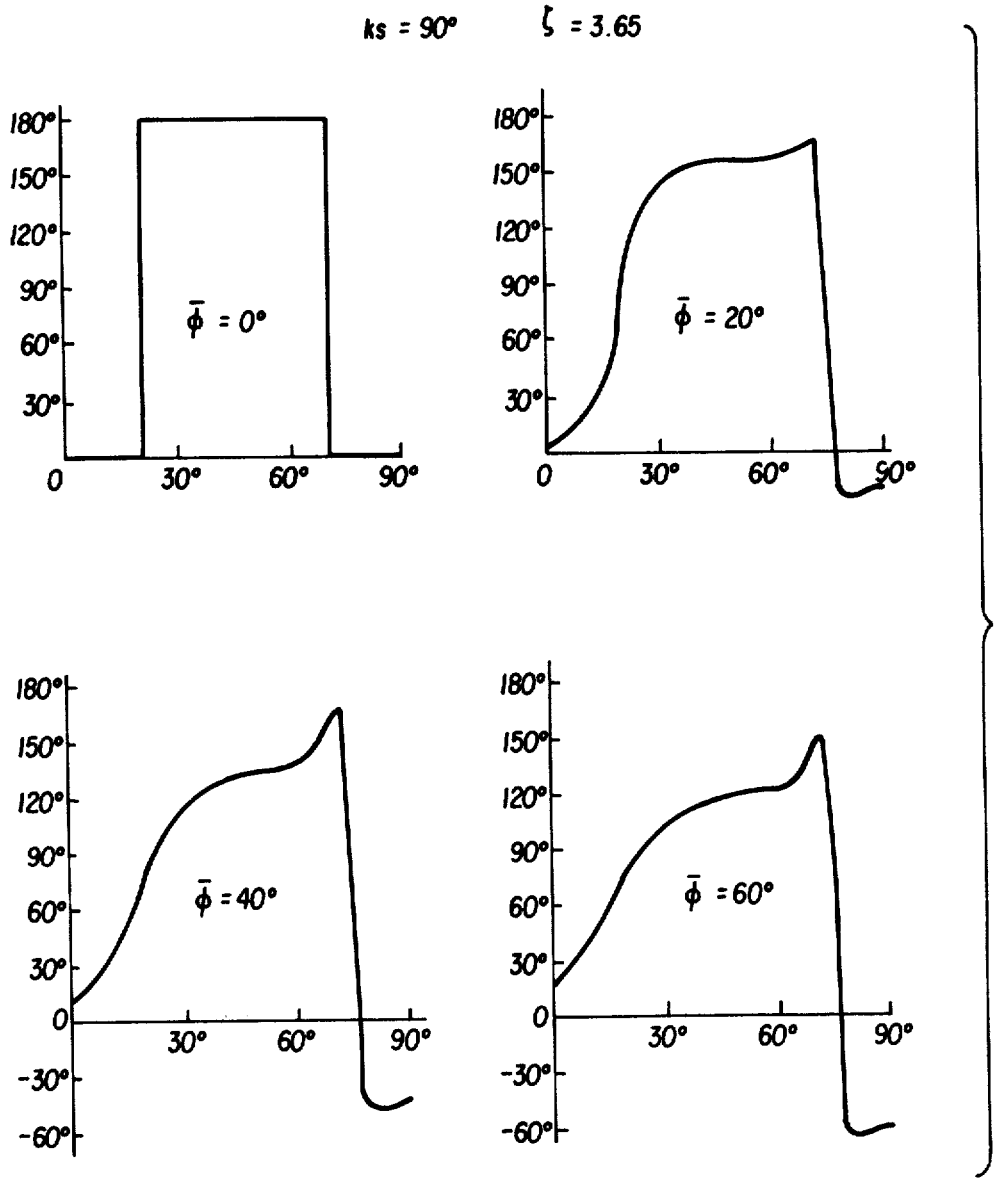

FIG. 9 Phase of the induced current along a 90° span plotted for several values of the angle $\Phi$ between the incoming wave front and the span.

Figure 10:
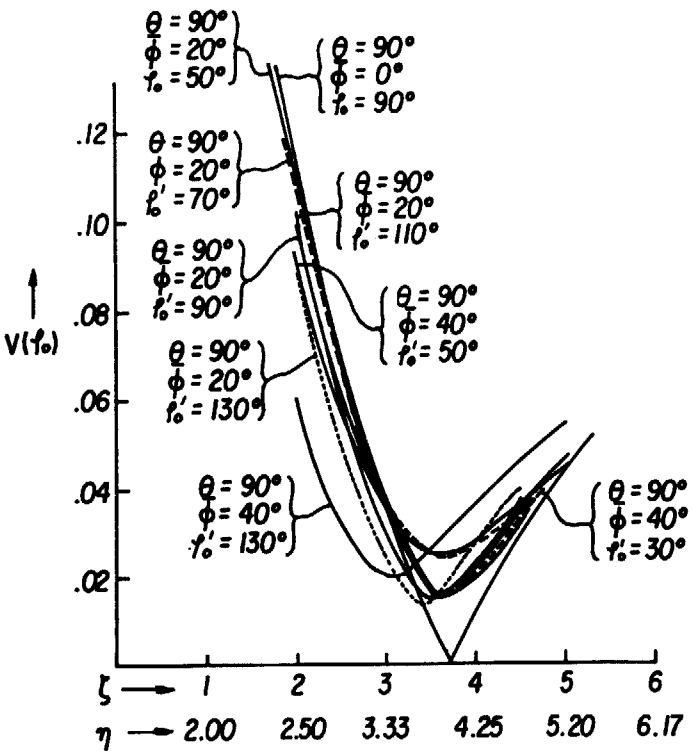

FIG. 10 Values of $\nu$ plotted as a function of $\zeta$ for several values of $\Phi$ and $\phi_o$. $\theta=90°$.

Figure 11:
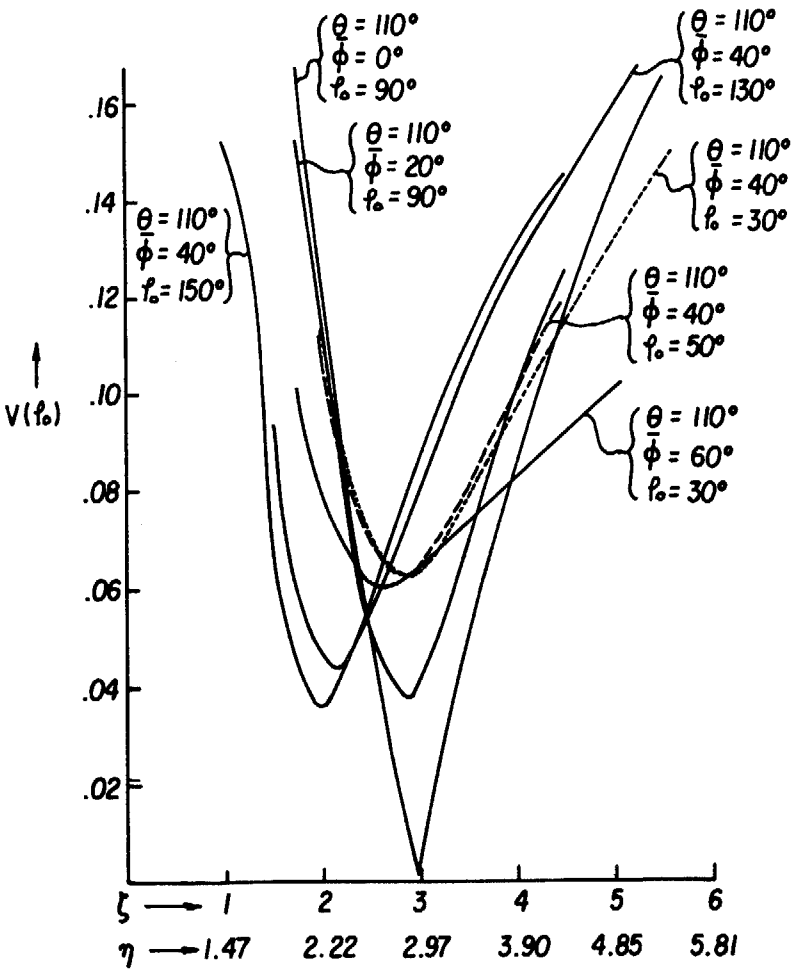

FIG. 11 Values of $\nu$ plotted as a function of $\zeta$ for several values of $\Phi$ and $\phi_o$. $\theta=110°$.

Figure 12:
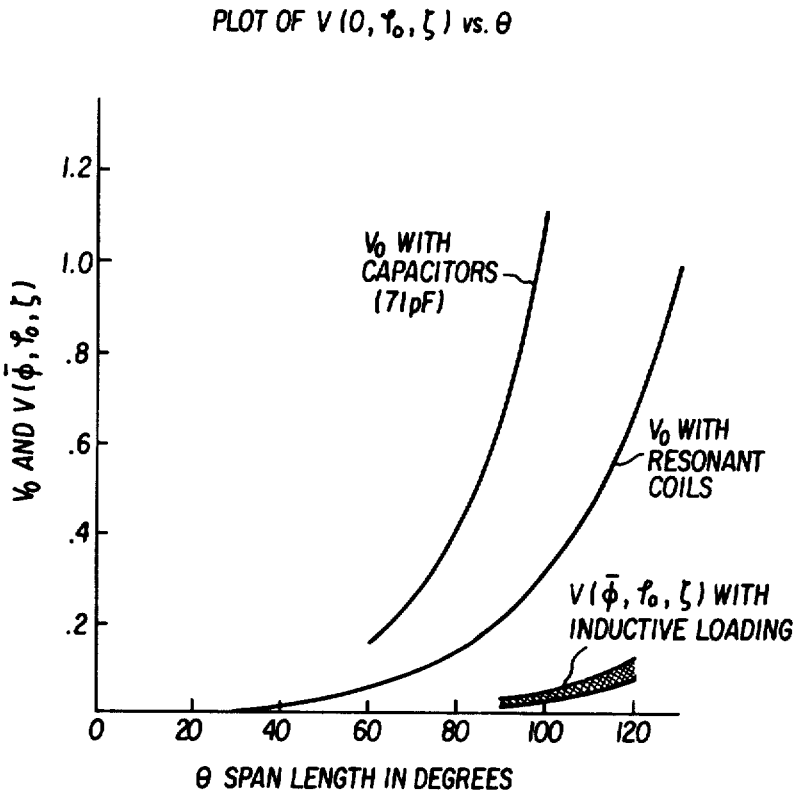

FIG. 12 Values of $\nu$ plotted as a function of span length.

Figure 13:
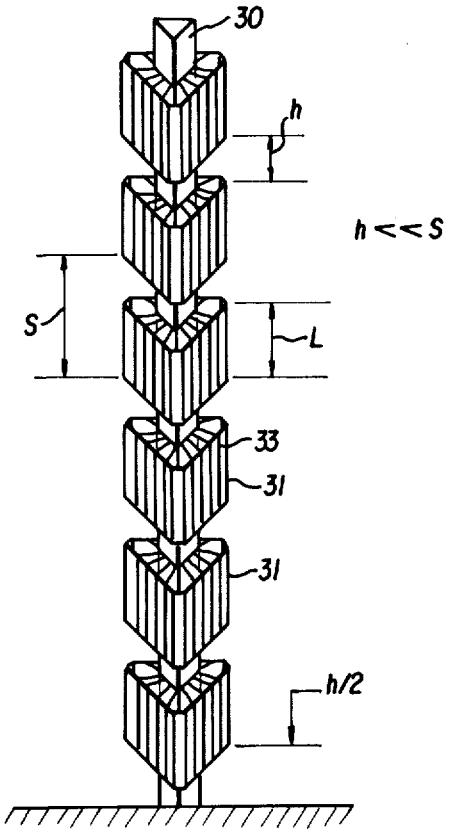

FIG. 13 shows a tower with wire sleeves. The length of each sleeve is shortened below one quarter wavelength to obtain the desired value of inductive impedance at the open ends in accordance with the invention.

Figure 1:
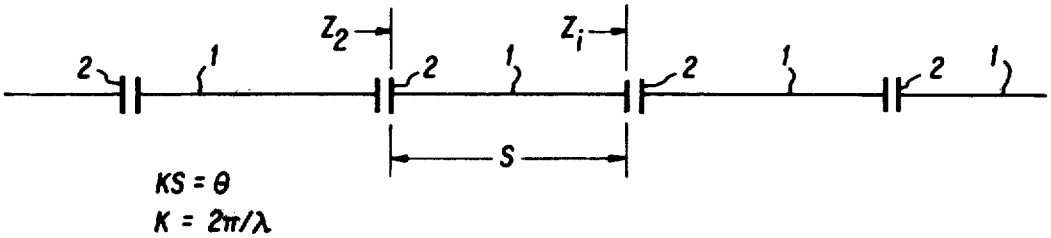
FIG. 1 shows a guy wire broken up by insulators and definitions of impedance $Z_i$, $Z_2$ and span length S.

FIG. 1 shows a diagrammatic view of a portion of a guy wire. In which 1 is a steel cable, 2 is a guy wire insulator which, in electrical terms, is equivalent to a capacitor having capacity C. $Z_i$ is the iterative impedance seen looking into a capacitor at a point next to the capacitor. $Z_2$ is the impedance seen at the other end of the span looking at $Z_i$ through one span of cable of length S. All spans and insulators in a given guy wire are assumed to have equal lengths.

In order to calculate re-radiation of a guy wire broken up into equal spans, it is desirable to first consider the guy wire as a transmission line which is excited by a generator in one of the spans or at one end of the guy wire. To do this it is necessary to find a value of the characteristic impedance $Z_o$ to be used in calculating the transmission through each span. An approximate value of the characteristic impedance $Z_o$ is given by equation 1:

$$Z_o=60\cdot ln(2S/d) \tag{1}$$

where S is the length of the span, d is the diameter of the guy wire and ln is the natural logarithm. It is convenient to express the impedance of one of the capacitors at the frequency of the inducing station in terms of $Z_o$. As usual, the impedance $-jX$ of the capacitor is given by equation 2:

$$jX=j1/C\omega \tag{2}$$

This value is in ohms. It can be expressed in terms of $Z_o$. Accordingly let $$\eta=x/Z_o \tag{3}$$

and $$\rho=\rho_o e^{j\mu}=(Z_i-Z_o/Z_i+Z_o) \tag{4}$$

Where $Z_i$ is the iterative impedance seen looking through one of the capacitors into a long guy wire broken up by similar capacitors as shown in FIG. 1 $\rho_o=|\rho|$ and $\mu$ is the phase of the reflection coefficient Once the value of $\rho$ is determined the iterative impedances can be calculated. Let $\theta$ be the electrical length of a span of length S. Expressed in radians $\theta=2\pi S/\lambda$ where λ is the wavelength at the frequency of the AM Radio station.

$$Z_2 = Z_o\frac{1+\rho\, e^{-j2\theta}}{1-\rho\, e^{-j2\theta}} \tag{5}$$

The impedance seen looking at $Z_2$ through the next capacitor of reactance $-jX$ is again equal to the iterative impedance $Z_i$. It follows that $$Zi = jX + Zo\frac{1+\rho\, e^{-j2\theta}}{1-\rho\, e^{-j2\theta}} \tag{6}$$

It can be shown that equation (6) is equivalent to two equations:

$$(\rho_o^2-1)\cdot \text{Sin}\,(u-\theta)=0 \tag{7}$$

and $$\rho_o^2-2\rho_o(2/\eta\ \text{Sin}\ \theta+\text{Cos}\ \theta)+1=0 \tag{8}$$

Let $$\gamma=2/\eta\ \text{Sin}\ \theta+\cos\theta.\ \text{When}\ \gamma^2>1$$

$\rho_o$ is real and waves can propagate along the guy wire. When $\gamma^2>1$, $\rho_o=1$ so that the guy wire behaves as a filter in the cut-off region. The parameters which determine the magnitude of $\gamma$ are (1) the span length $\theta$ between insulators and (2) the value of $\eta=X/Z_o=1-/Z_oC\omega$ where C is the capacitance of an insulator and $\omega=2\pi x$ frequency of the inducing field.

The cut-off region in terms of span length extends from zero to $\theta_c$ which can be determined from the equation $$\tan \nu_c/2 = 2/\eta \quad (9)$$

Since $\eta$ is negative $\theta_c$ comes out negative. One should therefore add 180 to the negative $\theta_c$ to get the correct value of $\theta_c$.

A guy wire with capacitors should be made with span lengths less than $\theta_c$ long. When this is the case each span may be considered by itself because the power extracted by the span from the inducing field is not passed on to other spans although wattless current does flow between adjacent spans.

Figure 2:
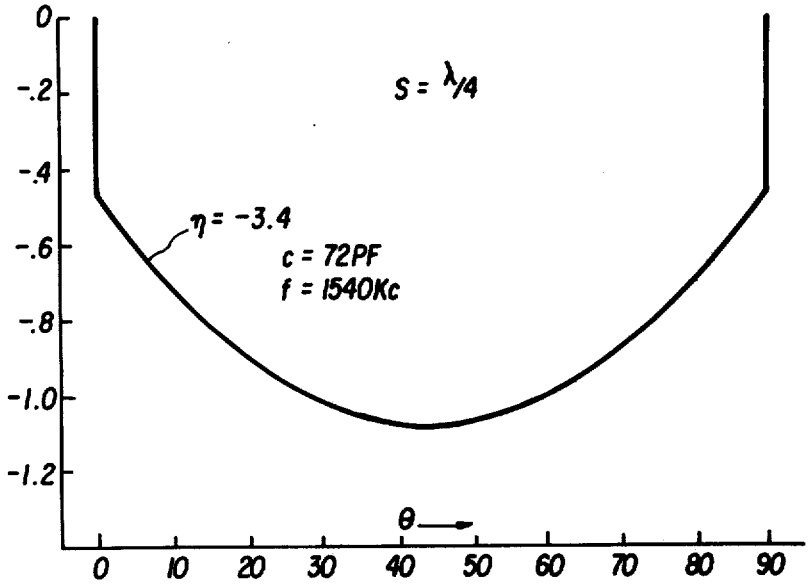
FIG. 2 shows the distribution of the calculated induced current in a span S=one quarter wavelength long (90 electrical degrees), assuming insulator capacity C=72 pF, and in a 60° span also with C=72 pF.

The current induced in an individual span of a guy wire may be calculated by extending the method described by A. Alford in the Proceedings of the IRE, February 1941. I find that when the span is parallel to the wave front the calculated current distribution is given by the following simple formula:

$$i = (E_o\lambda \cos \psi/2\pi Z_o)[1 - \Phi \cos (K\psi)] \quad (10)$$

Where $E_o$ is the inducing field in volts/meter; $\lambda$ = wavelength in meters, $\psi$ is the angle between $E_o$ and the span and $$\Phi = (1/\cos \theta/2 + 1/\zeta \sin \theta/2) \quad (11)$$

where $\zeta = Z_i/Z_o$ = the normalized iterative impedance. $\zeta$ is negative when $\eta = x/Z_o$ is negative. FIG. 2 shows the shape of the induced current in a 90° span with 72 pF capacitors.

There is a simple relation between $\zeta = Z_i/Z_o$ and u, in equation (4), namely, $\zeta = \text{Cotu}/2$. The value of can be calculated from $$\text{Cos}(u - \theta) = \text{Cos}\,\theta + 2/\eta \,\text{Sin}\,\theta \quad (12)$$

for given values of $\eta$ and $\theta$.

The vertical field re-radiated by a guy wire set as received at distance $r_o$ (meters) is found to be given by the following approximation equation $$|F| = \frac{30E_o\lambda}{\pi r_o} \cdot \theta_o \cdot \frac{\sin \xi}{\xi} \quad (13)$$

where $\xi = K\,b/2(\cos \Delta\alpha_o + \cos \Delta\alpha)$ b = The horizontal projection of the guy wire set $K = 2\pi/\lambda$ $\Delta\alpha$ = Azimuth angle (mathematical) as measured counter clockwise from the inducing AM radio station to the vertical plane containing the guy wire set $\Delta\alpha_o$ = the angle measured from the vertical plane of the guy wire set to the point where the re-radiated field is measured $$= \sum_i N_i \cos \delta_i \quad (14)$$

where $N_1$, $N_2$, $N_i$ is the number of spans in each guy wire is the angle made by the guy wire with the vertical $$\nu_o = [\Phi \,\text{Sin}\, \theta/2 - \pi S/\lambda] \quad (15)$$

S = length of span $KS = \theta$, $K = 2\pi/\lambda$ $$\Phi = (1/\cos \theta/2 + 1/\zeta \sin \theta/2) \quad (16)$$

$\zeta = Z_i/Z_o$ ($\zeta$ is negative when X is negative)

Typical values of $\nu_o$ obtained for C = 72 pF are plotted as curve 6 in FIG. 3. The capacity of the insulators which are suitable for withstanding the tensions in guy wires 1⅝ to 2 inches in diameter are large and are usually greater than 55 pF. One can, however, effectively decrease the capacity to zero by resonating the capacitor with a shunt inductor. Assuming a high Q circuit it is found that then $\zeta \to \infty$ and the corresponding curve for $\nu_o$ in FIG. 3 is curve 7.

In a typical guy wire set of 6 guys which is broken up into 90° spans, there is a large number of spans. For example, suppose the frequency of the inducing field is 1540 KHz $\lambda$ = 639 feet (194.8 meters). The number of spans is around 40. With 60° spans one would have about 60 spans per set of guys. There are three sets. The cost per insulator with hardware is of the order of $1,000.00. It is obvious that a decrease in span length from 90° to 60° results in an increase from 40 spans per set to 60 spans per set which would mean the extra cost of 3×20 = 60 more insulators.

The re-radiation pattern of a guy wire set is directional. An example of the patterns re-radiated by three guy wire sets is shown in FIG. 4. These patterns were calculated from equation (13). It is the last factor in (13) which is responsible for the directivity. The maxima of the three directional patterns in FIG. 4 are the same. For example: A guy wire set with 39 quarter wave (90°) spans and 72 pF capacitors, in the direction of a maxium radiates 86 mv/m at one mile for each volt/meter of the inducing field.

It is true, of course, that each span re-radiates a small amount but when radiations from 40 or 60 spans add up one gets a large signal. In order to visualize the size of this re-radiation one may compare it with re-radiation from a resonant quarter wave placed in the same field. It is 32 mv/m at one mile per v/m.

There are situations where re-radiation of 30 mv/m at 1 mile per v/m is more than one can tolerate from a set of guy wires. While confronted with this kind of a problem, one may ask the following question: Suppose that in an effort to reduce re-radiation by shunt coils one made the coils too small so that the negative reactants of the capacitors were replaced with positive reactances: Would re-radiation increase or decrease?

When X is positive equation (2) is still valid. In fact, all equations 2 through 16 are still good except that now X, $\eta$, $Z_i$, u and $\zeta$ are all positive.

A guy wire loaded with series inductors is, of course, a kind of a low pass filter. For example, for $\zeta = X/Z_o = +2.5$ (this means that the parallel circuit would have +j 1060 ohm reactance at 1540 KHz with $Z_o$ = 424 ohms), the guy wire would then behave as is shown in FIG. 5 in which the pass bands 10, 12 and cut-off bands 11,13 are plotted vs span length $\theta$. It is seen from equation (9) that with $\eta$ = 2.5 one could use spans between 77.3° and 180° provided that re-radiation from them was low.

The first cut-off band starts with $\theta_c$ and ends at 180°. The value of $\theta_c$ is found from equation (9). Since this time $\eta$ is positive $\theta_{c/2}$ is in the first quadrant. From equation (9) it may be seen that $\theta_c$ decreases as increases and vice versa.

For spans longer than $\theta_c$, but shorter than 180°, the guy wire is in a cut-off region. Within this region it may be used provided that the induced currents in the spans are small. In order to determine the magnitude of the induced current and to find its distribution in the span, one may again use equations (10) and (11), but in this case, the value of $\zeta$ is positive. FIG. 6 shows three curves: Curve 6 gives the current distribution in a 90° span of a guy wire with inductive loading having $\zeta=5.03$ which corresponds to $\eta=5.229$. Curve (8) shows the current distribution in a 60° span calculated using $\zeta=1.84$, which for $\theta=60°$, corresponds to $\eta=3.473$. The corresponding lower limits of the cut-off band are: $\theta_c=41.9°$, $\zeta=5.229$ for $\theta=90°$. For $\theta=60°$, $\eta=3.473$ and $\theta_c=59.9°$ Thus the 90° span with $\zeta=5.03$ would be operating well within the cut-off limit. The 60° span would be at the edge of the limit.

By comparing curve 6 in FIG. 6 with the current distribution for 90° spans with capacitors shown in FIG. 2, it can be observed that the inductive loading greatly decreases the current and furthermore that with inductive loading at the ends of the spans reverse currents are observed.

The shunt coil which would be required for $X=5.229\times Z_o=2217$ ohm impedance of the parallel circuit with, say, a 72 Pf capacitor. At 1540 MHz this would require that the inductance be 90 microhenries. The approximate dimensions of the coil should be as follows: diameter=6 inches, length=12 inches, number of turns=38. The wire diameter=0.128 inches. This coil could be incapsulated in a fiber glass cylinder filled with dielectric foam to exclude moisture. In comparison with the large sizes of the guy wire insulator assemblies, the dimensions of the coil are quite small and are believed to be practical.

Since the comparison of the current distributions in FIG. 6 with the current distribution in FIG. 2 shows that inductive loading gives lower currents than capacitive loading, it is useful to calculate the re-radiated field of a span and of a guy wire set. This may be done by using equations (13) through (16) with $\zeta$ now having positive values. The value of $v_o$ which one obtains for a 90° span with $\Phi=1.18$ is 0.049 This is to be compared with $v_o=0.68$ for typical capacitors. Other factors in the equation for the field of a guy wire set remain inchanged. Thus the field at one mile would decrease by the factor (0.049/0.68)=0.072 so that 86.0/mv/m at 1 mile per v/m would be reduced to 6.2 mv/m at 1 mile for 90° spans. This is a substantial improvement.

The value of $\zeta=Z_i/Z_o=5.03$ in FIG. 6 and for the calculation of the re-radiated field by a span was chosen to illustrate the nature of the induced current distrubitions and of the magnitudes of the re-radiated fields when the span lengths are well above the cut-off length $\theta_c$, which for 90° is 41.9°. One may well ask what value of $\zeta$ for a given span length results in the least re-radiated field. This condition of least re-radiated field is approached when $v_o=0$.

Strictly speaking $v_o=0$ means only that the field radiated at right angles to the span is zero, not that the signal is zero at other angles. It is found, however, that when $v_o=0$ the span radiates two very small minor lobes. Accordingly, let $$v_o=\Phi \sin(\theta/2)-\pi(S/2)=0 \tag{17}$$

For $S=\lambda/4$ ($\theta=90°$) it is found that $\Phi=1.1108$. This condition results in $\zeta=Z_i/Z_o=3.64$, $\eta=3.92$ and $\theta_c=56°$. Curve 8 in FIG. 6 illustrates this condition.

FIG. 7 shows the values of $\eta$ and $\zeta$ which result in $V_o=0$ at various values of $\theta_1$ condition $V_o=0$ means zero re-radiation at right angles to the span when the span is illuminated by a wave front which is parallel to the span. These values can be computed as follows:

Step 1: Equations (17) is solved for $\Phi$, the result is $$\Phi=\theta/2/\sin\theta/2 \tag{18}$$

where $\theta$ is the span length S expressed in electrical radians

Step 2: Equation 16 is then solved for $\zeta$:

$$\zeta=\theta/2/(1-\theta/R\cot\theta/2) \tag{19}$$

Step 3: The value of $\eta$ is calculated from the following equation $$\eta=\frac{X}{Z}=\frac{(1+\zeta^2)\sin\theta}{\zeta\sin\theta-\cos\theta} \tag{21}$$

$$=\frac{\left[\left(1-\frac{\theta}{2}\cot\frac{\theta}{2}\right)^2+\left(\frac{\theta}{2}\right)^2\right]\sin\theta}{\left(1-\frac{\theta}{2}\cot\frac{\theta}{2}\right)\left[\frac{\theta}{2}\sin\theta-\left(1-\frac{\theta}{2}\cot\frac{\theta}{2}\right)^2\cos\theta\right]}$$

The value of $\eta$ as calculated from equations (20) or (21) enables one to find the value of the positive reactance $X=\eta\cdot Z_o$ which would result in low re-radiation. The value of $Z_o$ is calculated from the approximate equation (1) in which S is the span length and d is the diameter of the conductor (guy wire).

Equation (10) which gives the distribution of the induced current is applicable only when the guy wire is parallel to the arriving wave front. I was able to solve the general case in which the guy wire makes any angle $\Phi$ with the arriving wave front. In the general case the current induced in a span is given by the following equation:

$$i=[e^{\cos(kz\sin\Phi)}+\sqrt{A_3^2+A_4^2}\cos(-kz+\beta_2)+\sqrt{A_1^2+A_2^2}\cos(kz+\beta_1)]\sin\omega t+[-e^{\sin(kz\sin\phi)}+\sqrt{A_3^2+A_4^2}\sin(-kz+\beta_2)+\sqrt{A_1^2+A_2^2}\sin(kz+\beta_1)]\cos\omega t \tag{22}$$

where Z is the distance measured along the span from the end at which the wave front arrives first, where $$\epsilon=k\delta\sin\phi,\ \epsilon=\frac{E\cos\Psi}{kz_o\cos\phi},\ \beta_1=\tan^{-1}\frac{A_1}{X_2},\ \beta_2=\tan^{-1}\frac{A_3}{X_4}$$

$$A_1=\frac{1}{\Delta}\{2D_1\sin\theta\,[N(\sin\theta+\xi\cos\theta)+MG]-2D_2[(\sin^2\epsilon-\sin\theta\sin\epsilon)G-MB]\}$$

$$A_2=\frac{1}{\Delta}\{-2D_1[MB-G(\sin^2\epsilon-\sin\theta\sin\epsilon)]+2D_2\sin\theta\,[N(\sin\theta+\xi\cos\theta)+MG]\}$$

$$A_3=\frac{1}{\Delta}\{2D_1\sin\theta\,[MG-(\sin\epsilon+\sin\theta)(\sin\theta+\xi\cos\theta)]+2D_2[(\sin^2\epsilon+\sin\theta\sin\epsilon)G-MB]\}$$

$$A_1=\frac{1}{\Delta}\{2D_1\,[MB-(\sin^1\epsilon+\sin\theta\sin\epsilon)G]+2\,D_2\sin\theta\,[GM-(\sin\epsilon+\sin\theta)(\sin\theta+\xi\cos\theta)]\}$$

-continued $$\Delta = \epsilon - 4\sin^2\epsilon\,(G)^2 - 4B^2$$

where $D_1 = \zeta\rho \sin\epsilon - \rho \sin\phi \cos\epsilon$ $D_2 = -\zeta\rho \cos\epsilon - \rho \sin\phi \sin\epsilon$ $B = 1 - \cos\theta \cos\epsilon + \zeta \sin\theta \cos\epsilon$ $G = \cos\theta - \zeta \sin\theta$ $M = \cos\epsilon - \cos\theta$ $N = \sin\epsilon - \sin\theta$ The solution was obtained by the same method which was used to derive equation (10), $\mathring{A}_1$, $\mathring{A}_2$, $\mathring{A}_3$, $\mathring{A}_4$ are the four constants of integration. They are found from the following end conditions existing at the two ends of a span:

(1) The current flowing into the downstream end of the span (the end where the wave front arrives last) flows into the iterative impedance which is j $Z_o$. This impedance is assumed to be a lumped impedance so that the current flowing out of it is the same in phase and magnitude as the current flowing into it, (2) The phase of the current at the upstream of a span is lagging by $\epsilon = KS \text{ Sin } \bar{\phi}$. The phase of the current at the upstream end of the preceeding upstream span.

If we put $\bar{\phi}=0$ equation (22) reduces to the simpler equation (10).

In order to visualize the meaning of the rather complicated equation (22) it is desirable to plot the distributions of the magnitudes and phases of the induced currents of a typical span length for several different values of angle $\phi$ between the guy wire and the wave front. FIG. 8 shows the calculated magnitudes of the currents induced in 90° spans connected through inductive impedances equal to 3.93 $Z_o$ (this is the value which results in $V_o=0$). It is seen that the current magnitudes have two minima along the span. FIG. 9 shows the phases of the induced currents which correspond to the magnitude shown in FIG. 8. For all four values of $\phi$ there are very large changes in phase of the current along the span. The difference in phase of the current entering and leaving the span is equal to the time of arrival of the inclined wave front. Expressed in degrees it is angle $\epsilon = KS \text{ Sin } \bar{\phi} = 90° \text{ Sin } \bar{\phi}$. For example: for $\bar{\phi}=60°$, $\epsilon=78°$. For spans 110° long the induced current and phase distributions are very similar to those shown in FIGS. 8 and 9.

Once the current and phase distributions are known it is possible to calculate the re-radiated signal by the well known proceedure: The re-radiated field F. is $$F = j\frac{60\pi \cos\psi \sin\phi_o}{\lambda r_o} e^{-jkr_o} \int_o^s i(z) e^{jkz\cos\phi_o}\, dz \tag{23}$$

where i(Z) is the current as given by equation (22) except that for the purpose of integration coswt and Sinwt are replaced respectively by unity and J. The two resulting integrals can be calculated in several ways; For example, When a current distribution has been calculated and plotted the integration can be readily carried out by numerical integration. The results can be plotted in various ways. In FIG. 10 the signal re-radiated from a 90° span is plotted VS. $\zeta$ which varies very nearly like $\eta$. In fact, for $\theta=90°$, as may be seen from equation (20)

$$\eta = \zeta + (1/\zeta)$$

For convenience, there are two abscissa scales in FIG. 10: The upper scale for $\zeta$ and the lower scale for $\eta$.

In FIG. 10 there are four families of curves: they are $\bar{\phi}=0$, $\bar{\phi}=20°$, $\bar{\phi}=40°$ and $\bar{\phi}=60°$. Each of these families of curves corresponds to a different value of the angle between the incoming wave front and the guy wire. In each family there are several curves corresponding to the directions in which the signal is re-radiated. These directions are defined by angle $\phi_o$ between the re-radiated ray and the guy wire. The vertex of this angle is at that end of the span where the wave front arrives first.

The zero re-radiated signal is obtained only when $\bar{\phi}=0$ and $\phi_o=90°$ which is the case corresponding to $V_o=0$. The value of $\zeta$ which for the zero-signal is as is shown in FIG. 7 for $\theta=90°$: $\zeta=3.6$, $\eta=3.9$.

The most striking feature of FIG. 10 is that all curves have well defined minima which occur at values of $\eta$ that are close to the value which result in $V_o=0$. This means that in order to get low re-radiation one should select values of inductance which correspond to the values of $\eta$ that preferably fall within one half and two times the value of $\eta$ that corresponds to $V_o=0$ for the selected span length $\theta$. This value of can be calculated from equation (21) or be read directly from such plots as FIG. 7.

FIG. II shows the four families of curves which give re-radiation from a guy wire with 110° spans. The similarity between FIGS. 11 and 10 is striking. Again, as in FIG. 10 all curves have minima which fall below but not very far from the point of zero re-radiation corresponding to $V_o=0$ in special case when $\bar{\phi}=0$, $\phi_o=90°$. As seen from FIG. 7 this point falls at about $\zeta=2.9$, $\eta=2.9$.

In order to get a more complete picture of these results I have plotted the relevant values in FIG. 12. This figure is similar and has the same scales as FIG. 3. Curves 6 and 7 have been recalculated and replotted somewhat more accurately than in FIG. 12.

In addition, there is shown a shaded area which represents the region obtained by the following procedure: Start with $\theta=90°$, FIG. 10 then shows the re-radiated signal for various combinations of $\zeta$, $\bar{\phi}$ and $\phi_o$. Let it be assumed that we select the best value of $\zeta$ which is about 3.6. Then, by reading off the ordinates of all of the curves at $\zeta=3.6$, it is found that they all fall between about 0.015 and 0.028. There are the limits of the shaded region in FIG. 12 at $\theta=90°$.

A similar process can be repeated with the aid of FIG. 11 for $\theta=110°$. For $\zeta=2.9$, the ordinates fall between 0.028 and 0.082. It should be noted that in case of guy wires, angles as large as $\phi_o=130°$, or 150° usually do not result in re-radiation into the sector to be protected. So that in a practical case the maximum ordinate $\theta=110°$, $\zeta=2.9$ would be about 0.06, not 0.082.

The above proceedure results in a reasonable approximation to the magnitude of the value of $\upsilon(\zeta, \bar{\phi}, \phi_o)$ which can be used just as $\upsilon_o$ in equation (13) was used to calculate the total radiation from a set of guy wires. The relative performance of the guy wire with approximately correct inductive impedances in comparison with the insulators with resonant coils (very large impedances) and insulators alone can be seen directly from FIG. 12. For example: for $\theta=90°$, insulators with resonant coils result is $\upsilon=0.22$. Whereas, the impedance in accordance with this invention would result in $\upsilon=0.028$. The improvement is by factor (0.22/0.028)=7.9. The improvement over insulators alone is by factor (0.65/0.028)=23.

FIGS. 10 and 11 show that a substantial improvement over the prior art is obtained even when the values of $\zeta$ and $\eta$ are fairly far from the best values. For example: for $\theta=90°$. At least a factor of 2 improvement is obtained between $\zeta=2$, ($\eta=2.5$) (0.64) and $\zeta=6$ ($\eta=6.17$) (1.58) Similarly, for $\theta=110°$ there is at least a factor of 2.8 improvement over the resonant coils between $\zeta=1.8$ ($\eta=1.96$) (1.48) and $\zeta=5$ (4.85) (1.67). It is thus seen that one may expect to obtain improved performance using values of $\eta$ falling between $\frac{3}{2}$ and 5/3 of the best value of $\eta$.

For approximate calculations of the desirable value of a very simple rule: $\eta=330/\theta$ where $\theta$ is in degrees. In terms of this rule the above stated limits are: $\eta=110/\theta$ and $\eta=550/\theta$. It is preferable to choose $\eta$ between $225/\theta$ and $430/\theta$.

There are practical cases where the conductor in which currents are induced is parallel to the wave front. A vertical wire or a tower located in the field of a vertical antenna are examples of such cases. In such special cases it should be possible to reduce re-radiation to very low values, provided that suitable inductances can be constructed.

The value of $v_o$ as given by equation (15) is zero at a certain value of $\zeta=\zeta_o$. For values of $\zeta<\zeta_o$, $v_o$ is negative. For values of $\zeta>\zeta_o$, $v_o$ is positive. Since $v_o$ is proportional to the re-radiated field the change in sign of $v$, when it passes through zero, means that the re-radiated field changes its phase by 180°. This fact may be used while making the final adjustments of the inductive impedances. One would observe the phase of the re-radiated field. A sudden, roughly 180°, excursion of the phase would indicate that one is passing through the correct adjustment.

There are several other aspects of this phase reversal at $\zeta=\zeta_o$. If one observes an increase in total signal with increasing value of $\zeta>\zeta_o$ one can decrease the total signal by using values of $\zeta$ below $\zeta_o$. One may also use this phase change to balance off the spans with $\zeta<\zeta_o$ by spans with $\zeta>\zeta_o$. When the wave front is not parallel to the guy wire the phase shift still exists but it becomes more gradual with increasing values of $\bar{\phi}$.

It should be pointed out, however, that the form of the inductive reactance is not important. For example, it may be a coil of wire, a parallel tuned circuit having inductive impedance or a section of a roughly concentric tube with one end connected to the wire and with the other end open. In fact, the latter structure may be used to decrease re-radiation at a high frequency from a metal rod, such as a structural member of a tower. The concentric tube may have longitudinal slots, or, in fact, may consist of a number of parallel wires. Such an inductor may be used to reduce re-radiation from a tower. Such wire sleeves or "skirts", as they are sometimes called, are usually made resonant to obtain the highest impedance when looking into the open end. According to this invention the substantially lower re-radiation can be obtained with inductive sleeves. The values of inductance being selected in accordance with the principles explained in this application.

FIG. 13 shows a tower 30 with sleeves 31 which are made of wire. In this figure the wires such as 33 in each sleeve are connected to the tower at their upper ends and are not connected to the tower at the lower ends. These wires are preferably connected with each other at the open ends. The length L of a sleeve is chosen so as to obtain the desired operating value of inductive impedance X. In this case $$X=Z_{oo}\tan(2\pi L/\lambda)$$

and $$\eta=(Z_{oo}/Z_o)\tan(2\pi L/\lambda)$$

where $Z_{oo}$ is the characteristic impedance of the pseudo-coaxial section of line formed by the tower and the sleeve within the sleeve and $Z_o$ is the weighted average characteristic impedance of outer conductor of the sleeve and a section of tower between sleeves. The value $\eta$ is chosen on the basis of the selected length of span S which, in this case, is the spacing between the successive open ends of the sleeves. Whether adjustable capacitors are used or not used in shunt with the open ends of the sleeves, the sleeves should appear inductive at their open ends. Sleeves may be oriented with their open ends up, or, in some cases, alternately in opposite directions.

I claim:

1. Means for decreasing re-radiation from a conducting cylinder comprising:
   (1) A transmitting antenna separated by some distance from said conducting cylinder,
   (2) A plurality of inductive impedances inserted at regular intervals $\theta$ electrical degrees long at the wavelength of the inducing signal,
   (3) Each such interval between inductive impedances being less than 180 electrical degrees long,
   (4) Each inductive impedance being between $(110/\theta)\cdot Z_o$ and $(550/\theta)\cdot Z_o$ ohms, where $Z_o$ is the characteristic impedance of the span between two successive inductive impedances.

2. Means for decreasing re-radiation from a conducting cylinder as in claim 1, wherein said conducting cylinder is a guy wire.

3. Means for decreasing re-radiation from a conducting cylinder comprising:
   (1) A transmitting antenna separated by some distance from said conducting cylinder and inducing high frequency currents in said cylinder,
   (2) A plurality of inductors effectively inserted in series with said cylinder separating it into a plurality of spans less than a half wave length long at the frequency of the induced currents,
   (3) The magnitude of each inductor being between $(250/\theta)\cdot Z_o$ and $(430/\theta)\cdot Z_o$ ohms, where $Z_o$ is the characteristic impedance of a span between two successive inductors and $\theta$ is the length of the span expressed in electrical degrees of the frequency of the induced currents.

4. Means for decreasing re-radiation as in claim 1, wherein inductors are substantially equal.

5. Means for decreasing re-radiation as in claim 1, wherein spans are substantially equal.

6. Means for decreasing re-radiation as in claim 1 wherein each inductor is a coaxial metal sleeve short-circuited to the cylindrical conductor at one end, and open-circuited at the other.

7. Means for decreasing re-radiation as claim 1 wherein each inductor comprises a plurality of wires substantially parallel to the cylinder interconnected with each other at intervals, said wires being insulated from the cylinder at both ends and connected to the cylinder through variable impedance at their centers.

8. Means for decreasing re-radiation as in claim 6 wherein the sleeve comprising a plurality of parallel wires of equal length arranged at intervals around the cylindrical conductor, said wires being interconnected at their insulated ends and connected to the cylinder through at least one variable capacitor.

9. Means for decreasing re-radiation from a conducting cylinder comprising:

(1) A transmitting antenna separated by some distance from the cylinder but inducing high frequency currents therein, (2) A plurality of inductors effectively inserted in series with said cylindrical conductor separating it into spans less than a half wavelength long at the frequency of the induced currents, (3) The magnitude of the inductors being substantially equal to $(330/\theta)\cdot Z_o$ ohms where $\theta$ is the length of a span expressed in electrical degrees at the frequency of the induced current and $Z_o$ is the characteristic impedance of the span between successive inductors.

* * * * *